US005862935A

United States Patent [19]

Dubois et al.

[11] Patent Number: 5,862,935

[45] Date of Patent: Jan. 26, 1999

[54] PLASTIC CONTAINER

[75] Inventors: Jean-Marc Dubois, Buttwil, Switzerland; Bernd Frommherz, Wutoschingen-Horheim, Germany; Thomas Jaussi, Spreitenbach; Boris Schwab, Baden, both of Switzerland

[73] Assignee: Georg UTZ Holding AG, Bremgarten, Switzerland

[21] Appl. No.: 607,834

[22] Filed: Feb. 27, 1996

[30] Foreign Application Priority Data

Feb. 28, 1995 [CH] Switzerland ..... 00 562/95
Oct. 2, 1995 [CH] Switzerland ..... 02765/95

[51] Int. Cl.[6] ..... B65D 43/04

[52] U.S. Cl. ..... 220/281; 220/284; 220/326

[58] Field of Search ..... 220/281, 284, 220/784, 789, 326

[56] References Cited

U.S. PATENT DOCUMENTS

| | | | |
|---|---|---|---|
| 3,840,152 | 10/1974 | Hodge . | |
| 4,022,352 | 5/1977 | Pehr | 220/281 |
| 4,520,943 | 6/1985 | Nielsen | 220/281 |
| 4,905,861 | 3/1990 | Boxall et al. | 220/284 |
| 5,050,762 | 9/1991 | Giorgi | 220/281 |
| 5,346,069 | 9/1994 | Intini . | |

FOREIGN PATENT DOCUMENTS

| | | |
|---|---|---|
| 0168877 | 1/1986 | European Pat. Off. . |
| 602536A2 | 6/1994 | European Pat. Off. . |
| 2185546 | 5/1972 | France . |
| 2565205 | 5/1985 | France . |
| 2700524 | 7/1994 | France . |

*Primary Examiner*—Joseph M. Moy
*Attorney, Agent, or Firm*—Ladas & Parry

[57] ABSTRACT

The container includes a lower part and a lid. The lower part is of a single wall structure and is reinforced at its upper edge area by a reinforcing wall. The lower end of the reinforcing wall is curved inwards and extends into the side wall. Thus, an edge at the lower end of the edge area is prevented. The upper edges of the lid are also rounded and run smoothly into the reinforcing wall. The lid includes ribs which, when the lid is placed on the lower part, come to lie onto corresponding ribs of the lower part. The lid is connected to the lower part by a snapping mechanism. The lid includes an opening, into which a ledge of the snapping mechanism can be snapped in. This ledge is accessible through this opening to release the ledge to disengage the opening.

16 Claims, 7 Drawing Sheets

PLASTIC CONTAINER

BACKGROUND OF THE INVENTION

1. Field of the Invention

The present invention relates to a plastic container having a lower part and a lid, which lower part includes a single-ply bottom and single-ply side walls and a reinforcing wall, which single-ply side walls have an upper peripheral end area, and which reinforcing wall extends along the upper peripheral end area, whereby a peripheral double wall edge area of the lower part is formed; which lid has an outer circumferential area via which it rests on said peripheral double wall edge area of the lower part. It further relates to a container having a lower part and a lid, which lower part includes bottom and side walls and a reinforcing wall, which side walls have an upper peripheral end area and which reinforcing wall extends along the upper peripheral end area, and having at least one snapping mechanism for a locking of the lid to the lower part, which snapping mechanism includes at least a first and a second member, which members are movable at least between a closed position and a release position, and in the closed position are snapped into each other and counteract an opening of the lid, and are adapted to be operated into a release position by a deformation thereof such to allow an opening of the lid.

2. Description of the Prior Art

Such plastic containers are suitable for a storing of various articles. When such containers are used for a transporting of such articles, problems can occur specifically if the container is transported, sorted and handled together with other commodities. If for instance plastic containers are simultaneously transported with containers made of cardboard, the cardboard containers may be damaged.

Furthermore, such plastic containers are not ideally suitable for a handling and sorting in plants that are designed for handling cardboard boxes. The plastic containers jam quite often in such plants. This can lead to a blocking and to damages.

Furthermore, high demands are made regarding the stability of such containers. Specifically the lid should lend itself to be securely mounted to the lower part of the container, i.e. to the body, such that it cannot be opened also in case of a careless handling. Thus, conventional intrinsic solutions, for instance based on spring steel clamps, have been selected for a mounting of the lid, which clamps have, however, been difficult to operate and/or expensive.

Hence, it is a general object to provide a plastic container in which its reinforcing wall is curved inwards towards its side walls along at least a part of its periphery of the edge area.

It has been recognized that the design of the peripheral area or circumferential area, respectively, of the container is quite important for preventing the above mentioned problems. By a curving or bending, respectively, the lower end of the reinforcing wall an edge or rib in this portion of the edge area can be done without in comparison with known solutions. This decreases the danger of a damaging of other wares and the risk of a jamming or hooking.

A further object is to provide a container in which the reinforcing wall is curved at its lower end and ends into the corresponding side wall. This leads to a reinforcing of the peripheral area and discontinuities in the outer wall are avoided.

Yet a further object is to provide a container which includes first rib members extending between the side wall and the reinforcing wall, and second rib members located along the outer area of the lid. These ribs act as supports for the lid in that the ribs of the lid rest on corresponding ribs of the lower part. Such a supporting on relatively short ribs lends itself to a production at substantially less costs in comparison with a supporting along the long edge of the side or reinforcing wall.

A further object is to provide a container in which the supporting rib members of the lid extend obliquely relative to the supporting lid members of the bottom part such that a secure supporting is obtained.

A further object is to provide a container in which the lid is curved downwards at its outer circumferential area. Thus, it forms the curved or round, respectively, upper edges of the container. Preferably, the lid extends via a small air gap without an edge or change of direction, respectively, into the reinforcing wall.

Still a further object is to provide a container in which a peripherally extending sealing member is arranged between the upper edge of the side walls and the lid, such that the container meets high demands regarding its sealing. If the lid rests simultaneously onto the ribs mentioned above, the sealing member is not subjected to overly large forces when stacking the containers.

Still a further object is to provide a container which includes elastic arresting tongues forming arresting members for mounting the lid to the lower part. They are mounted, for instance, to an edge area of the lower part and snap into the lid. In order to release the connection, the tongues must be pressed inwards. To this end, actuation openings are foreseen in the lid or in the reinforcing wall of the peripheral area. Each actuation opening is substantially smaller than the tongue located thereunder and is located somewhat above the tongue in a laterally centered manner. By this central locating of the actuation opening over the tongue, it is ensured that a central force is exerted when actuating the tongue. The actuation opening acts, furthermore, as safety shield which prevents an unintentional opening of the container.

Yet a further object is to provide a container which is nestable without its lid and can be stacked when the lid is placed thereupon.

Still a further object is to provide a container in which at least one handle opening is located in its peripheral area.

It is a further object of the present invention to provide a plastic container having a lower part and a lid, and which has at least one snapping mechanism for a locking of the lid to the lower part, which snapping mechanism includes at least a first and a second member, which members are movable at least between a primary closed position and a release position, and are adapted, furthermore, to move from the primary closed position into a secondary securing position upon an acting of a sufficient opening force thereupon, in which securing position they form a form-locked interconnection counteracting an opening force. Thus, when the lid of such a container is subjected to an opening force without the members of the snapping mechanism having been previously brought into an open position, the members move into a securing position in which they form a form-locked interconnection counteracting any opening force. The interconnection connected members cannot be released without irreversibly damaging these members.

Thus, a further object is to provide a container in which the locking members are not elastically deformed in their closed position. Such is of great advantage because locking members made of a plastic material are inclined to creep when subjected to a force.

Yet a further object is to provide a plastic container, in which at least one first member includes a tongue and one second member includes an abutment surface, hereby the tongue contacts the abutment surface in the primary closed position of the snapping mechanism. This is not necessarily to be understood as a permanent contact between tongue and abutment surface, the geometry can be selected also so that the tongue contacts the abutment surface merely upon an exertion of a small opening force.

A further object is to provide a plastic container in which in order to open the lid the tongue must be urged away from the abutment surface in a first direction, and in the case of a forceful opening force, according to which the forces act from a different connection, the tongue is urged in a second direction relative to the abutment surface. The members of the snapping mechanism can thereby be shaped in such a manner that a urging of the tongue in the mentioned second direction leads, for instance, to one snapping member to be placed in a hook-like manner over the abutment surface.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENT

Figure 1:
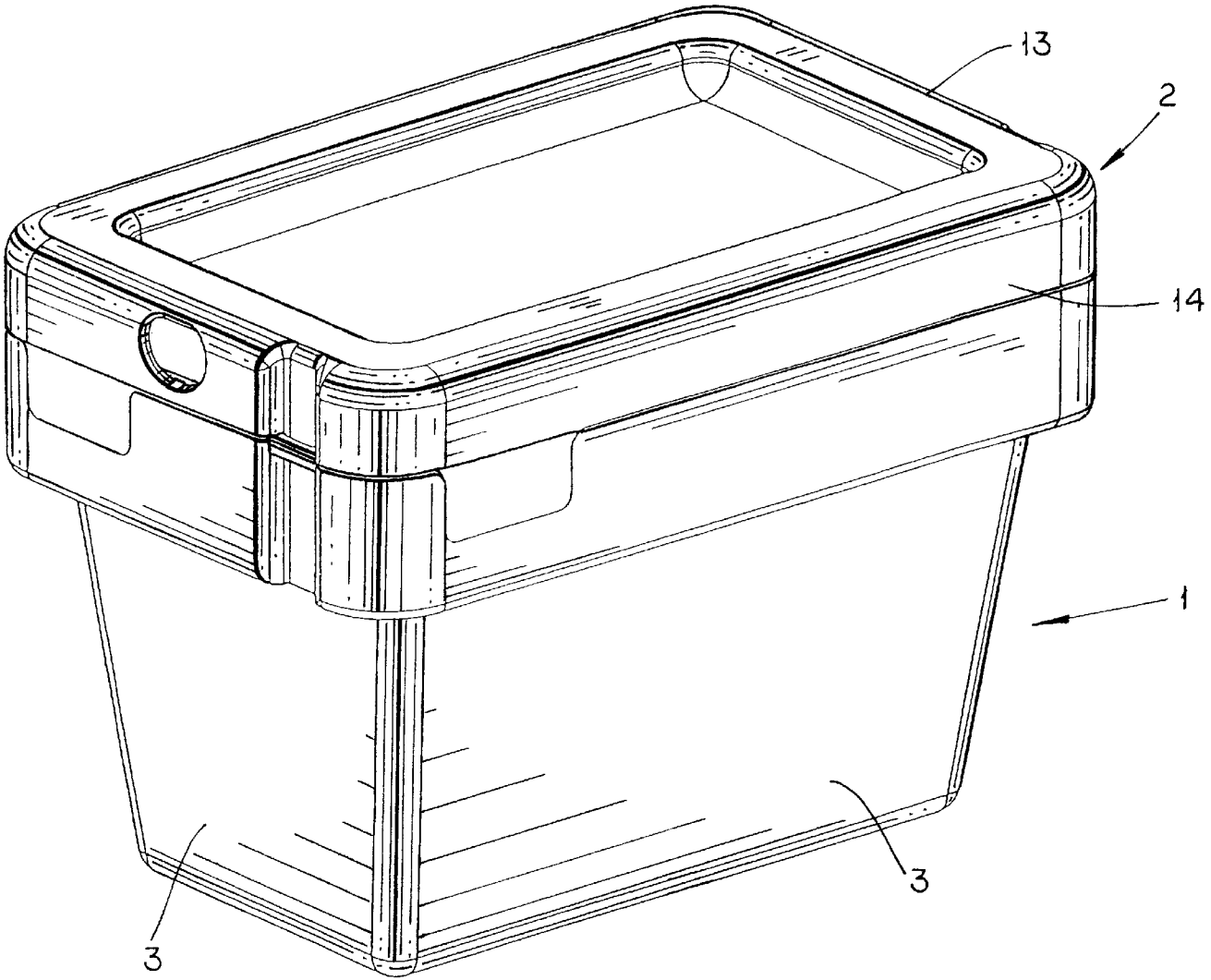
FIG. 1 is a view of a first embodiment of a container structured in accordance with the invention, in its closed state.
Figure 2:
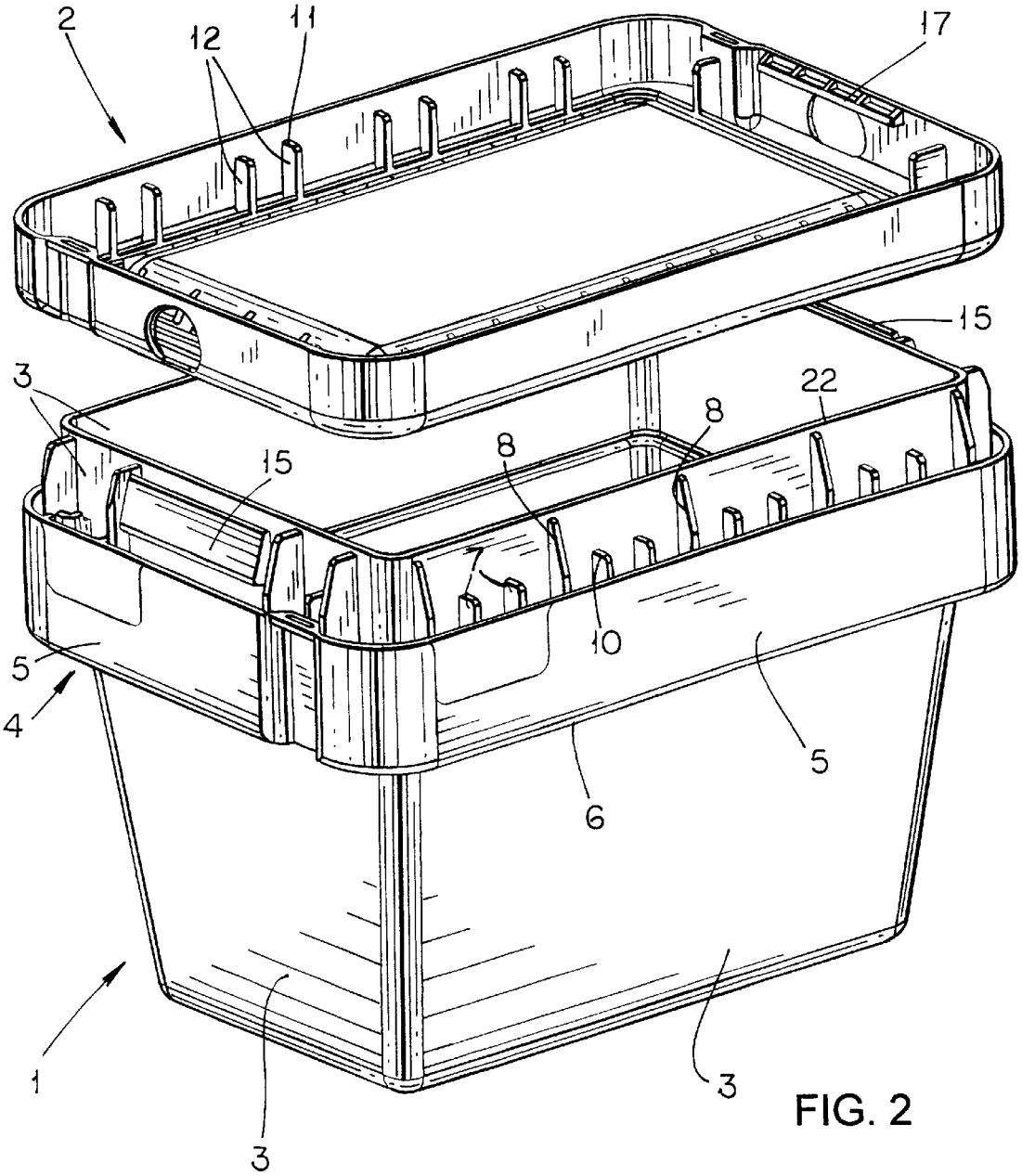
FIG. 2 shows the container of FIG. 1, whereby the lid is lifted off and turned upside down.

The general structure of a first preferred embodiment of the container is illustrated in FIGS. 1 and 2. It is thereby to be noted that the lid in FIG. 2 is shown turned upside down.

The container consists of two parts and includes a lower part 1 and a lid 2. The lower part 1 includes a bottom wall and four side walls 3, which are of a single-ply design and feature a substantially constant thickness. The side walls 3 converge somewhat downwards. The vertical edges between the side walls 3 and the horizontal edges between the side walls 3 and the bottom wall are rounded, such as is the case at all other outer edges of the container.

At its upper end, the lower part 1 forms a peripherally extending edge area 4. This edge area is of a double-wall design and includes as inner wall the respective side walls 3, and as outer wall a reinforcing wall 5. The side walls 3 and the reinforcing wall 5 extend in the edge area substantially vertically and parallel. The reinforcing area 4 reinforces the entire container and ensures its keeping its shape.

At its lower end 6, the reinforcing wall 5 is curved inwards and extends into the respective side wall 3. This is illustrated specifically also in FIG. 6.

As can be clearly seen in FIG. 1, the lid 2 is curved or round, respectively, at its outer circumferential area and passes into a vertical wall section 14. This wall section 14 ends above the reinforcing wall 5 of the lower part 1, whereby an air gap of a height of about 1 mm is formed between the vertical wall section 14 and the reinforcing wall 5.

Short and long ribs 7 and 8, respectively, extend between the side walls 3 and the reinforcing wall 5. These ribs stand vertically upright and form a reinforcing of the edge area. The long ribs 8 converge towards the top and form lateral guides when the lid is set onto the lower part. The short ribs 7 have horizontal upper edges and form a support for the lower edges 11 of corresponding ribs 12 of the lid 2.

In order to ensure a safe supporting, ribs 7 and 12 do not extend exactly parallel to each other. This can be specifically seen in FIG. 3, which illustrates a top view onto the edge area of the container. The parts of the lid are thereby designed in broken lines. Clearly recognizable is here the angle between the ribs 7 and 12. By this angle it can be avoided that the ribs 12 come to lie, e.g. due to a deforming of the lid, laterally at the side of the ribs 7. Thus, a safe, clearly defined support is produced which is in the position to take up also large stacking forces.

Figure 3:
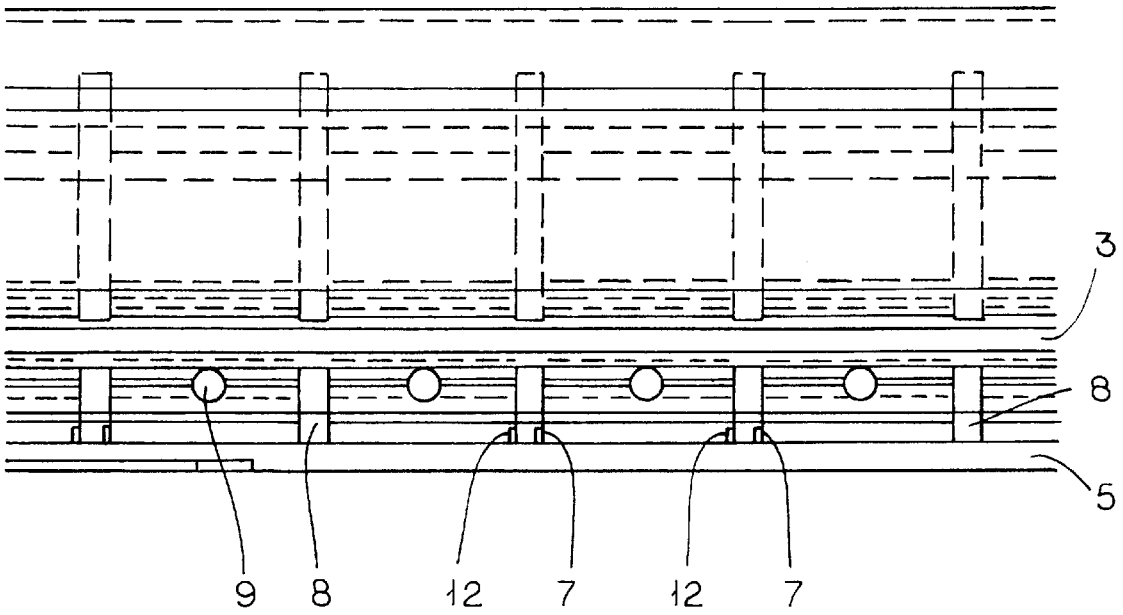
FIG. 3 shows a top view of a part of the peripheral area, whereby parts of the lid are drawn with broken lines.

Furthermore, openings 9 are illustrated in FIG. 3, which are arranged at uniform distances at the lower, horizontally extending end area 6 of the reinforcing wall 5. These openings prevent an accumulating of water at the edge area 4.

Figure 4:
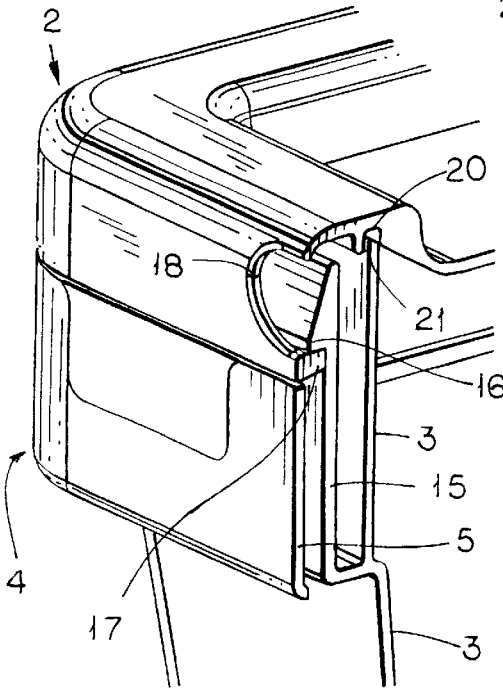
FIG. 4 shows a section through the edge of the container in the area of its closure members.

In order to mount the lid 2 onto the lower part 1, an arresting tongue 15, shaped as snapping member, is formed on each narrow end of the container. The arrangement and function of these tongues can best be seen in FIG. 4.

Each tongue 15 is connected at its lower end to the side wall 3 and extends vertically upwards. At its upper end it is equipped with a projection 16 with a ramping surface which snaps into a projection 17 of the lid 2. In order to release this connection, the tongue must be pressed inwards against its spring force. To this end, an actuation opening 18 is foreseen in the lid. It is located laterally centered over the upper end of the tongue 15 and ensures that the pressing force is always exerted centrally onto the tongue 15. The actuation opening 18 acts, furthermore, as protecting shield and prevents that the tongue can be accidentially pressed inwards.

The container as designed in FIGS. 1 to 3 is splash-proof. To this end, an elastic sealing ring 20 (FIG. 4) is foreseen between the upper edge 22 (FIG. 2) of the side wall 3 and the lid 1. This sealing ring is located in a groove 21 of the lid and extends, when the lid is placed onto the lower part, along the entire upper edge 22 of the side wall 3. Accordingly, the inner space of the container is sealed at all places.

It is hereby to be noted that the sealing ring 20 does not act as support for the lid—for this purpose the ribs 7 and 11 are foreseen. This prevents the sealing ring 20 from being additionally compressed when the containers are stacked.

Figure 5:
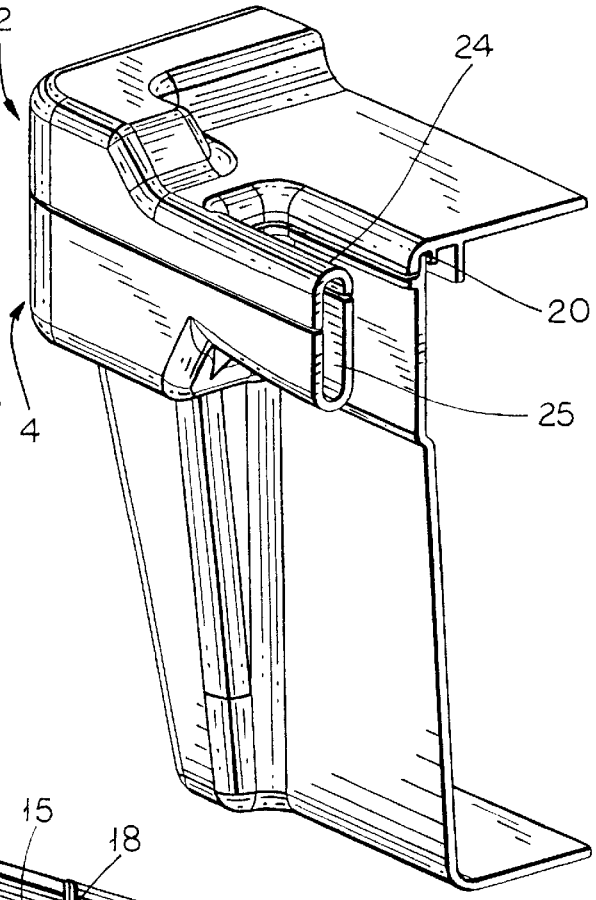
FIG. 5 is a view of a second embodiment of the container having a handlehold.

FIG. 5 illustrates a partial view of an alternative embodiment of the container structured in accordance with the invention. At both narrow ends of this container a handhold opening 24 is foreseen. This opening extends through the edge area 4 of the lower part 1 and the lid 2, whereby corresponding openings are formed in the edge area 4 and in the lid 2. The edge area and the lid thereby form a rounded grip 25. The sealing ring 20 extends inside of the handholding opening 24 such that a sealing of the inner space of the container remains ensured.

At the embodiment according to FIG. 5 the arresting tongues are not located at the narrow side but rather at the broad sides of the container. Because the container of this embodiment is larger than the one according to FIG. 1, two arresting tongues 15 each are foreseen at each longitudinal side. One of these tongues is shown in part in FIG. 6.

Figure 6:
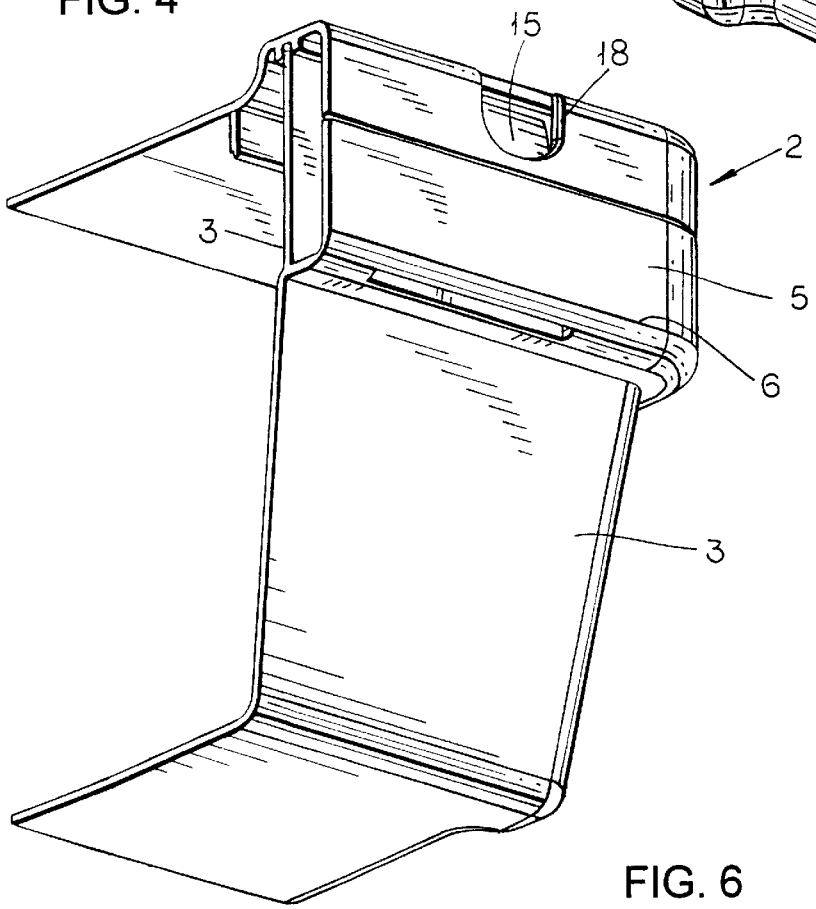
FIG. 6 is a view of the locking members of the embodiment according to FIG. 5.

As can be seen from FIG. 6, the reinforcing wall 5 is also rounded inwards at its lower end 6 and extends into the corresponding side wall 3. This is the case substantially along the entire circumference of the container, with the exception of the handhold area.

The container structured in accordance with the invention is designed in such a manner that it is nestable without lid and stackable with the lid. This is illustrated in FIGS. 7 and 8.

Figure 7:
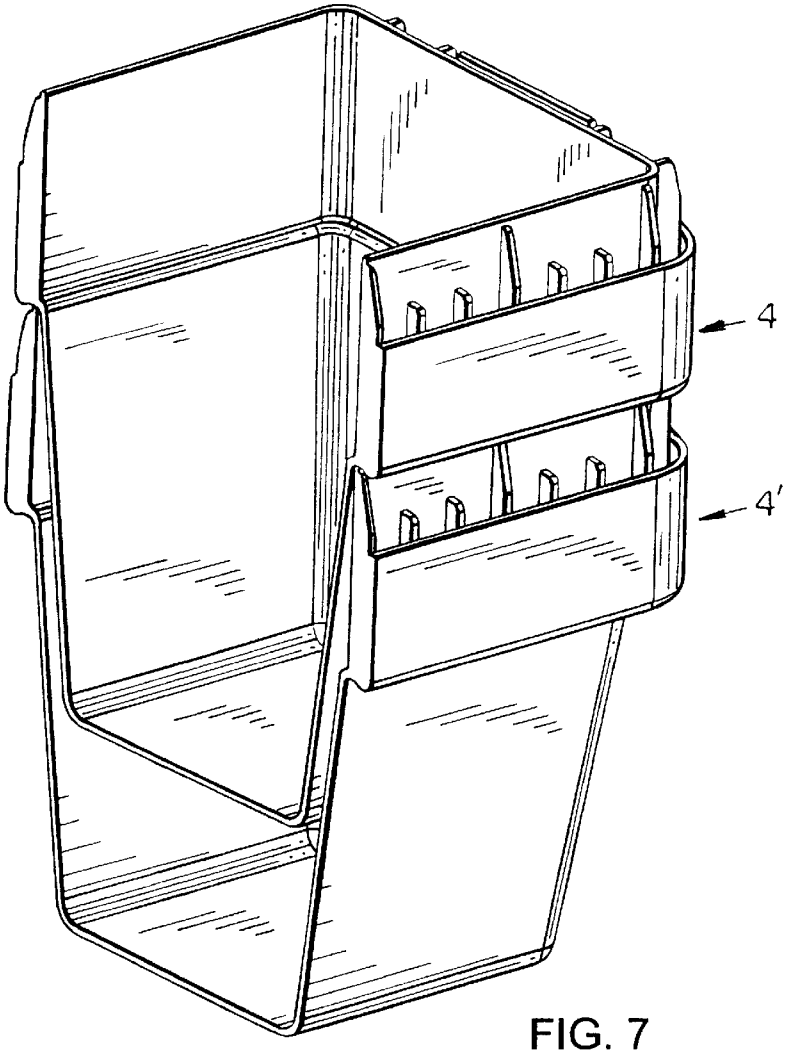
FIG. 7 is a view of nested containers of FIG. 1.

At the nested stated illustrated in FIG. 7, the lower end of the edge area 4 of a container lies on the upper end of the edge area 4' of the next lower container. To this end, the lower part is reduced somewhat below its edge area.

Figure 8:
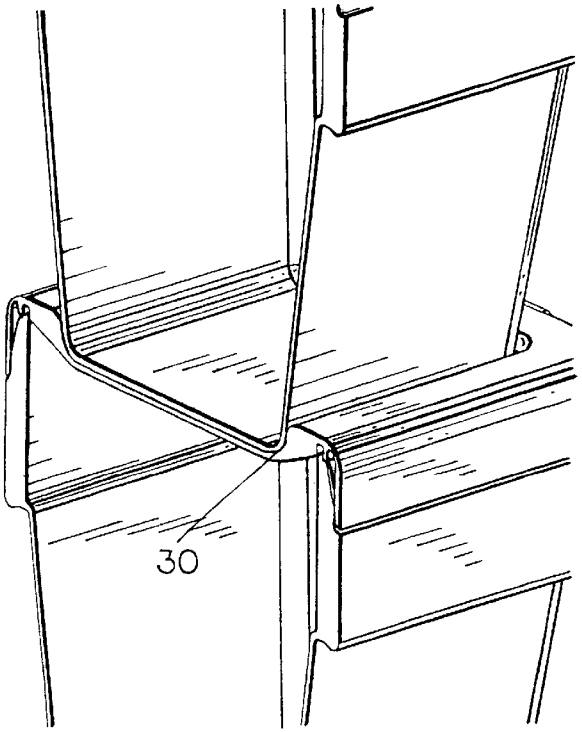
FIG. 8 is a view of stacked containers according to FIG. 1.
Figure 9:
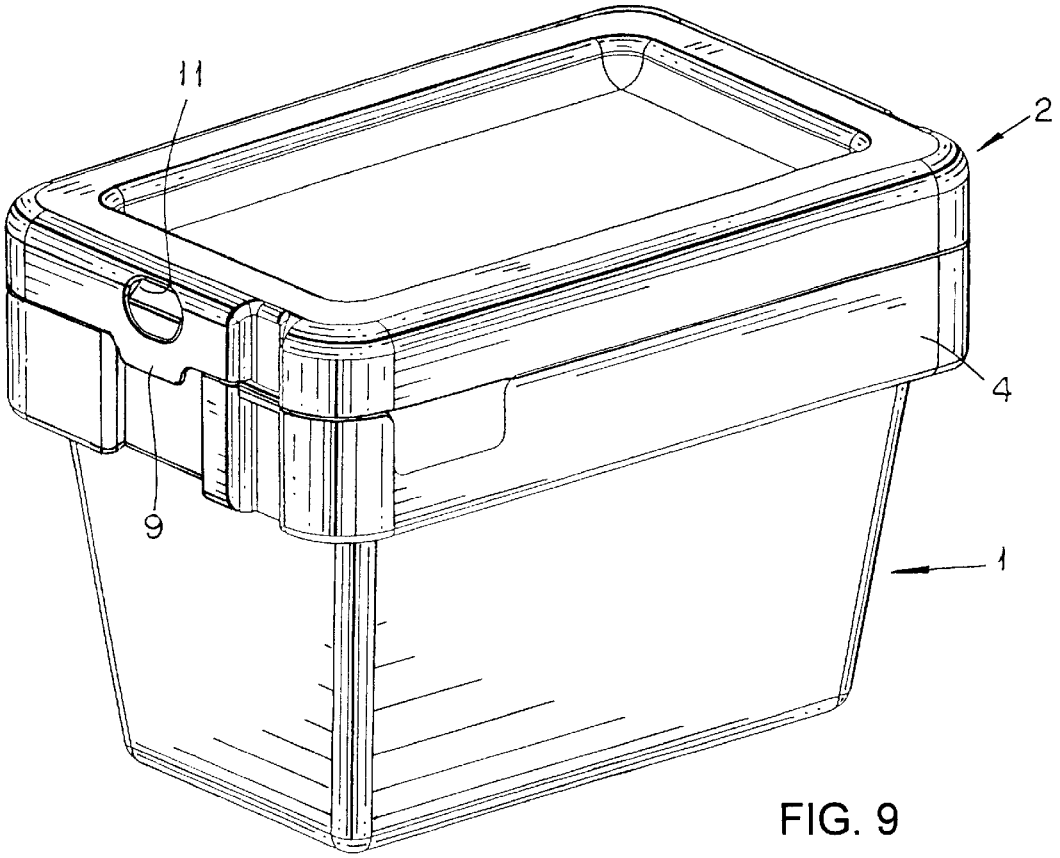
FIG. 9 is a view of a further embodiment of the container structured in accordance with the invention.

At the stacking of the containers illustrated in FIG. 8, each container stand in a recess 30 of the lid of the following lower container, whereby the recess 30 is designed to conform to the shape of the bottom of the container. Thus, a safe, aligned stacking is ensured.

The container structured in accordance with the invention is suitable to be produced by injection-molding.

Figure 10:
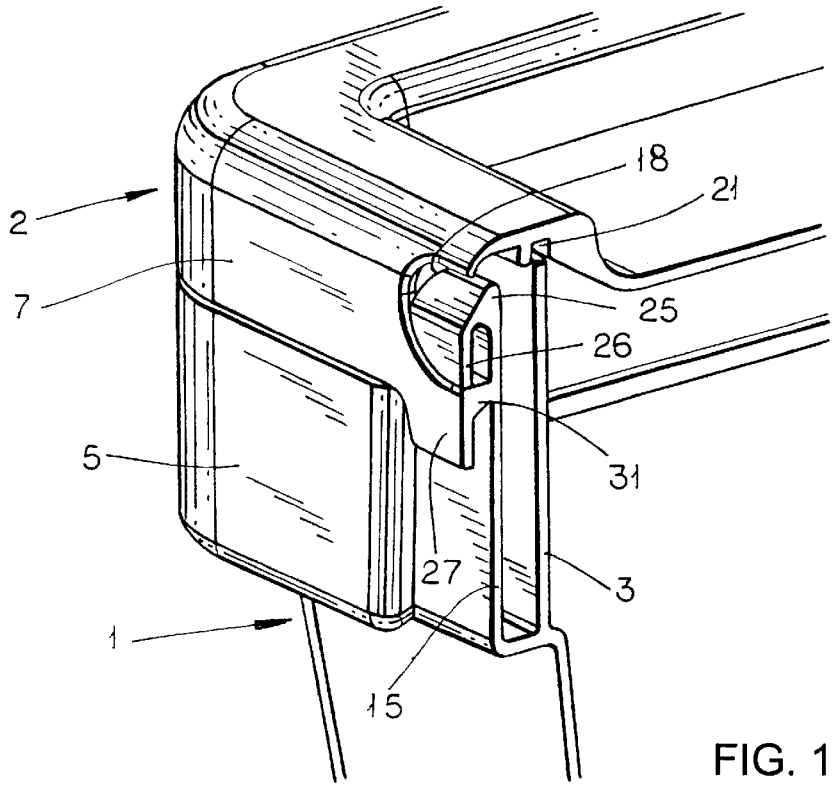
FIG. 10 is a view of a section through part of the container illustrated in FIG. 9.

Attention is now drawn to FIG. 10, illustrating the basic design of a yet further embodiment of the container in accordance with the invention. The embodiment illustrated is a plastic container produced by an injection-molding process having a volume of about 10 liters.

The container is structured of two parts, the lower part 1 and the lid 2. The upper edge area 4 of the lower part 1 is reinforced forming a double wall. As illustrated in FIG. 10, the side wall 3 of the lower part 1 projects into a circumferential groove 21 of the lid 2 and prevents a lateral shifting of the lid 2 relative to the lower part 1. The reinforcing wall 5 of the lower part 1 is aligned with the vertical wall section 14 of the lid 2.

Figure 11:
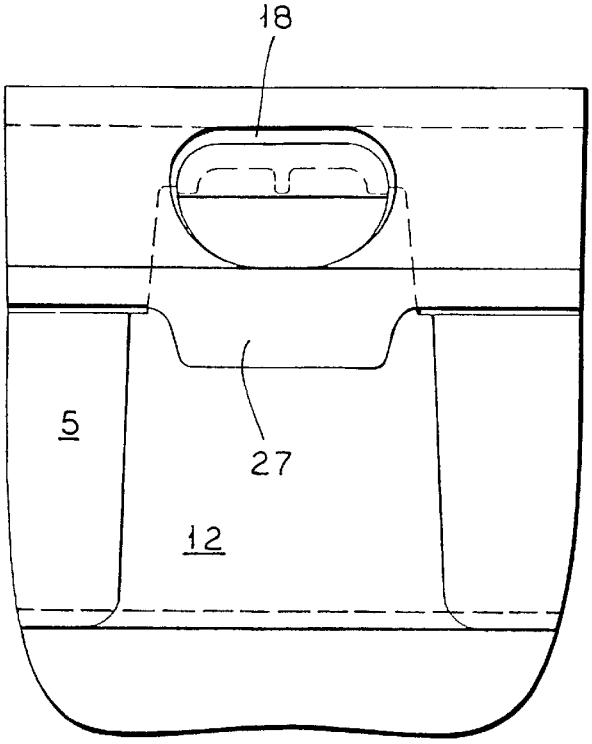
FIG. 11 is a front view of a snapping mechanism.
Figure 12:
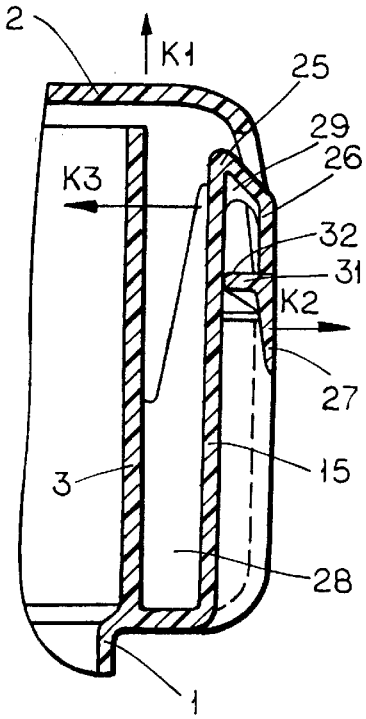
FIG. 12 illustrates a vertical section through the snapping mechanism.
Figure 13:
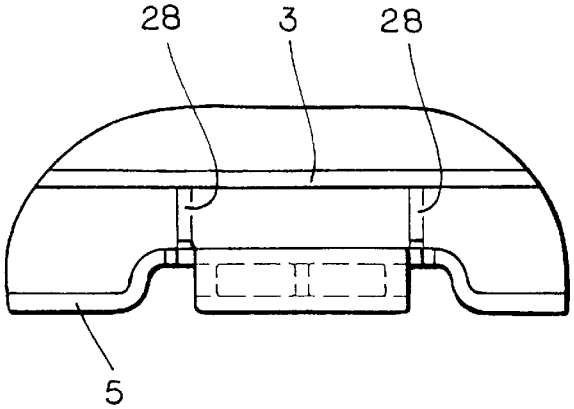
FIG. 13 is a top view of the lower part of the container without lid and at the area of the snapping mechanism.

The lid 2 is to be releasably mounted to the lower part 1 as shown in this embodiment by two snapping mechanisms located on opposite sides of the container, of which snapping mechanisms only one is illustrated in FIG. 10 and 11. Depending on the size and shape of the container, the number of snapping mechanisms can obviously also be larger or smaller.

The design of the snapping mechanism will now be explained based on FIGS. 11 to 14.

The snapping mechanism consists of two closure members, of which one is affixed onto the lid 2 and the other one to the lower part 1. A first closure member of lower part 1 is a resiliently mounted engagement means and includes a neck 15, a head portion 25, and a tongue 26, and a second closure member of lid 2 includes an actuation opening 18 and a grip 27.

Neck 15 is formed in a recessed area between vertical reinforcing wall 5 and side wall 3 and is positioned to extend substantially parallel to a longitudinal axis of the lower part. It is reinforced by two ribs 28. At the lower area of the neck 15 these ribs extend up to the side wall 3 and converge in an upward direction. At its upper end the neck 15 extends to a head section 25, which forms a curvilinear transition to a tongue 26, the tongue 26 being transversely spaced from the neck 15. The head 25 is reinforced at its inner side by three ribs 29.

The tongue 26 is flush with the outer side of the edge area of the lid. This avoids an accidental operating or a catching at other objects.

The bottom end of the tongue 26 contacts the lower edge of the opening 18. This edge forms together with a ledge 31 an abutment surface 32. Ledge 31 provides the other closure.

The snapping mechanism is illustrated in FIGS. 10 to 14 in its locking state. In this position it counteracts an opening of the lid. If a pulling force K1 which is not too large is exerted onto the lid 2 (see FIG. 12), this force will be transmitted via the abutment surface 32 onto the neck 15 and accordingly to the lower part 1.

In the locking position all parts of the snapping mechanism are relaxed, i.e. they are not subject to an elastic deformation. This prevents a creeping of the plastic material and a permanent deformation of the parts involved.

In order to open the lid 2, the snapping mechanism must be brought into an open position. To this end, the operator places e.g. his index finger behind the grip 27 and presses with his thumb onto the tongue 26. Thus, the operator exerts lateral forces K2 and K3. The edge area of the lid 2 will deform thereby elastically outwards. At the same time an elastic deforming of the tongue 26, of the head section 25 and of the neck 15 in an inward direction is caused. The neck 15 thereby moves from the abutment surface 32 inwards, such that the lid is released and may be opened.

In order to close the lid 2, it is simply set onto the lower part 1. The grip 27 and the ledge 31 urge thereby the chamfered head section 25 inwards. As soon as the tongue has reached the height of the opening 18, the head moves due to its spring action again outwards into its locking position.

Figure 14:
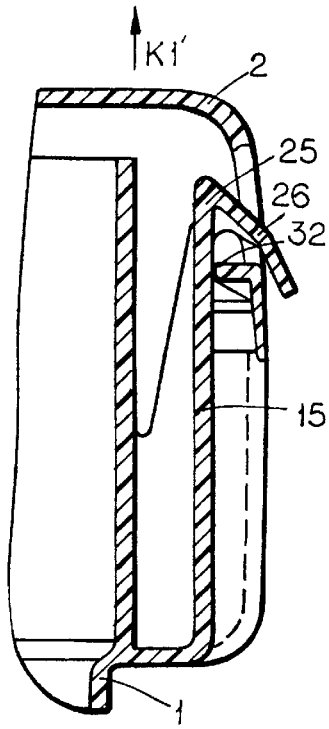
FIG. 14 is a vertical section through the snapping mechanism in its securing position.

If the snapping mechanism is in its locking position and an extremely large pulling force K1' is exerted along an opening direction outwardly of the lid, the snapping mechanism is brought into a securing position, which is illustrated in FIG. 14. The head section 25 and the tongue 26 are thereby deformed, and the tongue 26 is biased transversely, that is, the tongue 26 slides towards the outside of the abutment surface 32 provided by ledge 31 so as to be displaced over the ledge 31 to reach around the ledge 31 to engage the adjacent side wall of the lid, to prevent inward transverse displacement of the engagement means for permitting release of the lid. The abutment surface is lifted somewhat and withheld in a hook-like manner by the head section 25. By means of this, a further upward movement of the lid 2 is prevented. The lid 2 could be lifted still further only at a considerable deforming or even destruction of the snapping mechanism.

In order to ensure that the tongue 26 moves in the case of a larger force K1' automatically towards the outside, the illustrated embodiment includes an abutment surface 32 which is somewhat chamfered or slanted outwards. Additionally, the tongue is positioned already in its normal locking position close to the outer edge of the abutment surface 32. The desired deformation is thereby supported further in that the curved head section 25 is positively widened somewhat by the force K1' and is bent somewhat inwards such that the tongue 26 attains an outward-directed position. The tongue 15 is, on the other hand, designed somewhat stiffer such that the head area 25 and the tongue 26 cannot pivot as one part inwards. These various measures complement each other ideally in the illustrated embodiment but can also be applied individually in order to cause the tongue 26 to slip upon exertion of a large force K1' forward of the abutment surface 32.

The embodiment of the invention illustrated in the figures can be quite easily produced by an injection-molding. Therefore, the neck 15 is formed as part of the outer reinforcing wall 5, such that the area under the head section 25 is easily accessible and can be taken out of the form in one production step. The two closure members are integrally formed onto the lower part 1 and the lid 2, respectively, and do not need any further production steps for their production.

Due to the here described design, the container is quite stable. Even when it falls from a larger height level onto the ground, the lid will not get detached. Lateral forces acting onto the lid are transmitted by the groove 21 and suitable reinforcing ribs, respectively, onto the lower part 1, and pulling forces are taken safely by the snapping mechanism.

While there are shown and described preferred embodiments of the invention, it is to be distinctly understood that the invention is not limited thereto, but may be otherwise variously embodied and practised within the scope of the following claims.

We claim:

1. A plastic container comprising:

a lid, a lower part having a bottom wall, side walls and a reinforcing wall, which reinforcing wall extends along an upper, peripheral end area of said Bide walls, said lid being movable away from said lower part along an opening direction, and at least one snapping mechanism for locking said lid to said lower part, said snapping mechanism comprising a ledge providing an abutment surface mounted to one of said lid and said lower part and a snapping member mounted on the other of said lid and said lower part, wherein said snapping member comprises an engagement means resiliently mounted for opposing inward and outward transverse movement relative to said opening direction, and the abutment surface of the ledge is engageable with said resiliently mounted engagement means for releasable engagement of the lid and the lower part, said engagement means being so constructed and mounted and so positioned on said ledge in the locking position of the lid that on application of sufficient outward force to said lid along said opening direction and relative to said lower part said engagement means is biased in the outward transverse direction so as to be displaced outwardly of said ledge to reach around said ledge so as to prevent transverse displacement of the engagement means in the inward opposite transverse direction for permitting release of the lid.

2. The plastic container of claim 1, in which said engagement means comprises a tongue portion extending from a hook-shaped head portion, said tongue portion being positioned on said ledge.

3. The plastic container of claim 2, in which said engagement means further includes portion, and said hook-shaped head portion forms a curvilinear transition between the tongue and said neck, said neck being reinforced such that upon an exertion of said opening force said neck deforms less than one or both of the head and the tongue portions.

4. The plastic container of claim 1, in which said ledge is chamfered so as to facilitate the displacement of said tongue portion over said ledge.

5. The plastic container of claim 1, in which said lid is provided with an opening located in a side wall thereof, said opening having a lower edge forming said ledge.

6. The plastic container of claim 5, in which said lower edge of the opening includes a projection for a broadening of the abutment surface.

7. The plastic container of claim 2, in which an outer surface of the tongue is substantially in alignment with an outer surface of the lid.

8. The plastic container of claim 1, wherein to release said members the opening is adapted to be elastically urged outwardly of said container and the tongue is adapted to be elastically urged inwardly of said container.

9. The plastic container of claim 8, in which the lid further comprises a grip extending downwardly from the lower edge of the opening.

10. The plastic container of claim 5, in which said engagement means includes a neck portion and said head portion forms a bent transition between the tongue and neck portions, and in which the neck is a portion of an outer wall of the lower part.

11. A plastic container comprising:

a lid;

a lower part having a bottom wall, side walls and a reinforcing wall, which reinforcing wall extends along an upper, peripheral end area of said side walls, said lid being movable away from said lower part along an opening direction of said container, and at least one snapping mechanism for locking said lid to said lower part, said snapping mechanism comprising engagement means resiliently mounted to said lower part for opposing inward and outward transverse movement and an opening in a side wall of the lid having an abutment surface engageable with the resiliently mounted engagement means for releasable engagement of the lid and the lower part, said engagement means being so constructed and mounted and so positioned on the abutment surface that on application of sufficient force along the opening direction outwardly of said lid relative to said lower part said engagement means is biased transversely so as to be displaced outside of said opening to engage the adjacent side wall of said lid so as to prevent inward transverse displacement of the engagement means, said inward transverse movement permitting release of the lid.

12. A plastic container according to claim 11, wherein said engagement means comprises a neck portion which is positioned to extend substantially parallel to a longitudinal axis of the lower part, a tongue portion and a head portion interconnecting the neck and tongue portions, the distal end of the tongue portion resting on the lower surface of the opening, and said tongue portion being transversely spaced from said neck portion so that when said sufficient force is exerted on said lid, said tongue portion is biased outwardly from the longitudinal axis of said neck portion and into engagement with the adjacent side wall of said lid.

13. A plastic container according to claim 12, wherein the head and tongue portions are relatively deformable as compared to the neck portion.

14. A plastic container according to claim 13, wherein said neck portion is reinforced by flanking ribs extending transversely between said side wall and said reinforcing wall of said lower part.

15. A plastic container according to claim 12, wherein said abutment surface including a lower edge of said opening.

16. A plastic container according to claim 15, wherein the opening includes a projection for providing the abutment surface.

* * * * *

UNITED STATES PATENT AND TRADEMARK OFFICE

CERTIFICATE OF CORRECTION

PATENT NO. : 5,862,935

DATED : January 26, 1999

INVENTOR(S) : Jean-Marc DUBOIS, et al.

It is certified that error appears in the above-identified patent and that said Letters Patent is hereby corrected as shown below:

| | | |
|---|---|---|
| Column 7, | line 40, | "Bide" should be – side –. |
| Column 8, | line 4, | after "includes" insert – a neck –. |
| Column 10, | line 2, | "including" should be – includes –. |

Signed and Sealed this

Third Day of August, 1999

*Attest:*

*Attesting Officer*

Q. TODD DICKINSON

*Acting Commissioner of Patents and Trademarks*